United States Patent [19]

Brod

[11] 3,964,529

[45] June 22, 1976

[54] PURSE KIT

[76] Inventor: William F. Brod, 236 Wildwood Ave., Pitman, N.J. 08071

[22] Filed: Jan. 18, 1973

[21] Appl. No.: 324,856

Related U.S. Application Data

[63] Continuation-in-part of Ser. No. 188,683, Oct. 4, 1971, abandoned.

[52] U.S. Cl. ..... 150/32; 206/223

[51] Int. Cl.[2] ..... B65D 3/00

[58] Field of Search ..... 150/28 R, 28 A, 32; 206/47 R, 223, 231

[56] References Cited

UNITED STATES PATENTS

| | | | |
|---|---|---|---|
| 1,479,591 | 1/1924 | L'Enfant | 150/32 |
| 1,586,248 | 5/1926 | Komura | 150/29 R X |
| 1,978,257 | 10/1934 | Gardiner | 150/28 R X |
| 1,984,122 | 12/1934 | Felmann | 150/32 |
| 2,587,033 | 2/1952 | Dobbs et al. | 150/28 R |
| 2,621,696 | 12/1952 | Barnes | 150/30 |
| 2,694,427 | 11/1954 | Hovis | 150/28 A |
| 3,186,461 | 6/1965 | Erickson | 150/28 R |
| 3,358,903 | 12/1967 | Stefano et al. | 229/61 |

*Primary Examiner*—Stephen P. Garbe
*Attorney, Agent, or Firm*—Charles F. Duffield

[57] ABSTRACT

A purse kit for assembling a purse employing an outside covering chosen and provided by the purchaser. The kit includes a prescored stiffening member about which the outside fabric is folded, a preformed liner which is adhesively secured about its perimeter to the folded edges of the covering fabric and stiffening member and suitable hardware cooperating with perforations in the liner to provide footrests and a closure fastener for the purse.

1 Claim, 5 Drawing Figures

PURSE KIT

BACKGROUND OF INVENTION

The present invention is concerned with purses and, more specifically, with a kit for home creation of a purse. The present application is a continuation in part application of application Ser. No. 188,683, now abandoned, Filed Oct. 4, 1971 by William F. Brod.

Women's fashion and desires today, both in formal and informal dress, give rise to the desire for such accessories as purses to be an exact match of the fabric in the garment itself. However, manufacturers of women's clothes seldom, if ever, produce an accessory such as a purse of the same fabric as the garment itself. Accordingly, matching purse designs are unavailable in stores.

Women who create their own clothes and fashions at home nearly always have an excess of the material from which the garment was made. Occasionally, the seamstress will take this extra material and recover an old purse with the material to create the matching purse. However, recovering of old purses can be a difficult and sometimes not too satisfactory job.

OBJECT AND SUMMARY OF INVENTION

It is the object of the present invention to provide a means by which identically matching purses may be quickly, easily and inexpensively created from remnants to perfectly match the fabric of home creations.

The foregoing object is carried out by the present invention by providing a kit from which a purse may be created utilizing the matching remnant as the outer covering. The kit includes a prescored stiffening member which, when folded, assumes the configuration of a purse. The kit also includes a liner of approximately the length and width of the stiffening member and suitable hardware such as closure members and footrests.

The purse is assembled by covering one side of the stiffening member with the remnant material and folding the edges thereof over the opposite side of the stiffening member. The liner which is provided with the kit is positioned over the opposite side of the stiffening member overtop of the inwardly folded edges of the remnant. An adhesive material may be provided on the perimeter of either the liner or the stiffening member of either the pressure or heat sensitive type and serves to adhere the liner, enfolded edges of the remnant material and the stiffening member together as a unit.

The liner includes side panels which may be permanently sewn in place to form the pocket inside of the purse in one embodiment. In another embodiment, the side panels are formed of opposed flaps which are secured along one edge to the lining member and the opposite edges include a pressure sensitive material which permits the liner to be secured in place while flat but to be formed into a pocket by folding the opposite edges of the flaps into engagement with one another.

The stiffening member includes apertures at predetermined positions. The hardware includes tabs which are adapted to pass through the apertures and be bent into locking engagement to provide the footrests and closure member for the purse.

Other objects and advantages of the present invention will become apparent to those skilled in the art from the following detailed description thereof taken in conjunction with the drawing.

DESCRIPTION OF INVENTION

Figure 1:
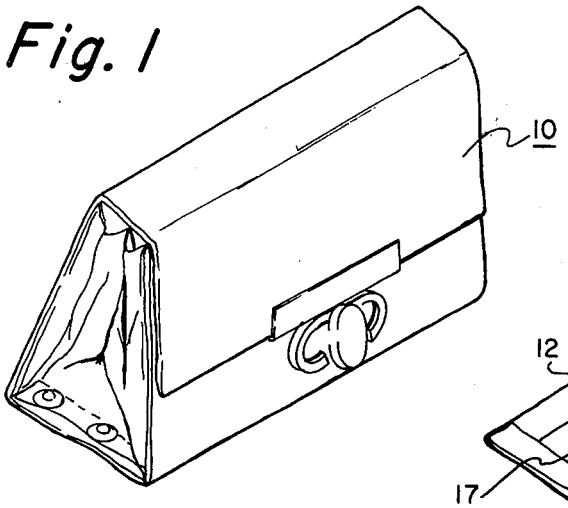
FIG. 1 is a perspective view of the purse kit of the present invention in assembled and closed position.

The completed purse 10, when assembled with the materials of the kit of the present invention and folded into closed position, is shown in FIG. 1 of the drawing. The same purse is shown in FIG. 5 in a partially open position.

Figure 2:
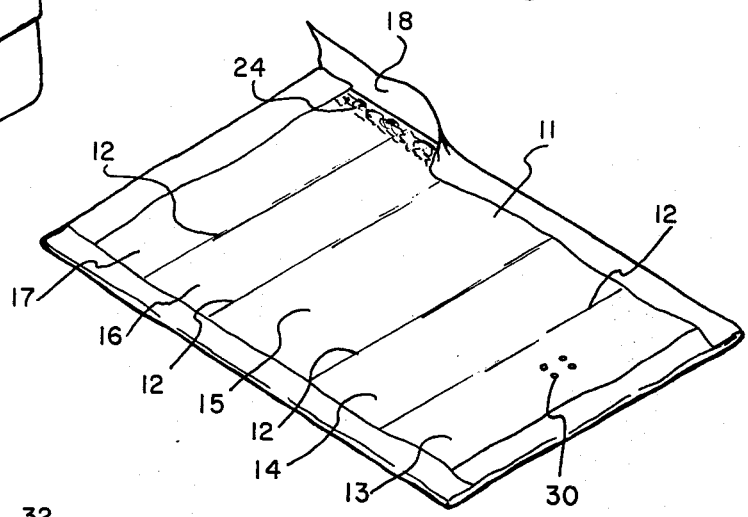
FIG. 2 is a perspective view of the stiffening member and fabric covering in place.
Figure 5:
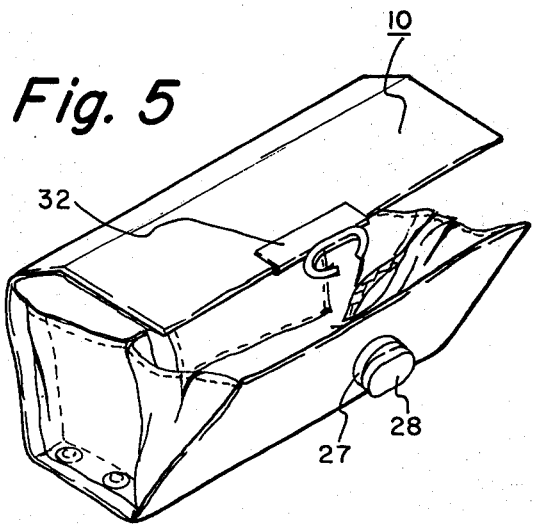
FIG. 5 is a perspective view of the assembly of FIG. 3 folded into a purse configuration.

The purse kit shown in FIGS. 1 and 5 includes a prescored stiffening member 11 shown in FIG. 2. The stiffening member 11 includes a plurality of score lines 12. The stiffening member is of a fiber material such as cardboard and the score lines are impressed into the cardboard to a sufficient depth to permit the stiffening member to be bent or folded along the score lines.

The stiffening member includes four score lines which define five panels 13–17. The score lines are dimensioned one from another such that, when the liner is folded into the purse configuration shown in FIGS. 1 and 5, panel 13 will form the front of the purse and panel 14 forms the bottom of the purse. In a like manner, panel 15 forms the back side of the purse while its adjacent panel 16 forms the top of the purse and panel 17 the front flap of the closure for the purse.

In accordance with the invention, the purchaser of the kit utilizes a matching remnant of some completed garment as the outside covering material 18. The outside covering is cut to a dimension slightly in excess of the length and width of the prescored stiffening member. The covering or fabric is placed over one side of the stiffening member and its extending edges folded over into engagement with the opposite side of the stiffening member as shown in FIG. 2.

The purse kit of the present invention also includes a liner 19 for the purse. The liner 19 is a fabric material and includes a first panel 20 which is of length and width just slightly less than the length and width of the stiffening member. The outside perimeter or edges of the panel 20 are turned under and sewn in order to prevent raveling of the edges of the panel.

Figure 3:
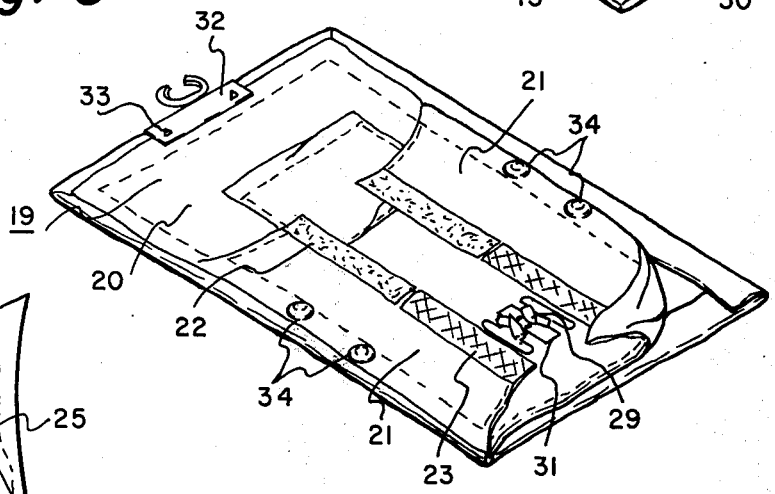
FIG. 3 is a perspective view of the stiffening member after assembly of one embodiment of liner.

The liner 19, in the embodiment shown in FIGS. 3 and 5, further includes two opposed flaps 21. The flaps may be separate pieces of material sewn along their outside edges to the panel 20 or they may be of the same piece of material as the panel 20 and folded over and sewn along the outside edge along with the border of the panel 20. In either case, the panels 21 are of a length to extend over the width of the side, bottom and back panels 13, 14 and 15 respectively of the stiffening member. Each of the panels 21 also extend inwardly toward one another a distance slightly in excess of the width of the bottom panel 14.

The inside edges of the panels 21 include a pressure sensitive locking material along the length of the edge. One suitable type of material which may be employed is that commonly known as Velcro. This type of material employs a flocculent material as one part of the locking member and a plastic hook tape as the mating part for the flocculent material. Where material such as Velcro is used, and as shown in FIGS. 3 and 5, the flocculent material 22 will be placed on one half of the inside edge of the panel 21 and the hook tape section 23 on the opposite half of the inside edge.

The assembly of the purse kit is accomplished by placing the liner 19 over the inturned edges of the covering material 18. In one embodiment of the kit, the stiffening member 11 includes a heat sensitive adhesive material 24 along the perimeter or border of the stiffening member as shown in FIG. 2. In this embodiment, the covering fabric is placed on the opposite side of the stiffening member from the adhesive material and the edges folded over against the adhesive material. The liner is then placed over the flaps and a hot utensil such as an iron passed around the border of the liner. The adhesive material is of sufficient thickness to pass through the covering fabric 18 and adhere to the underside of the lining 19 thus bonding the covering material and lining to the stiffening member.

In another embodiment of the kit, the liner 19 may, itself, include the adhesive material on the underside of the border of the liner. In this case, a utensil such as an iron may be passed around the border to this time melt the adhesive through the covering fabric 18 and adhere to the stiffening member to adhere the liner and covering to the stiffening member.

It is also contemplated that the adhesive to secure the covering and liner to the stiffening member may be of a pressure sensitive type. Additionally, where a pressure sensitive type of adhesive is used, it may be likewise placed on the border of the stiffening member or on the border of the front liner.

Figure 4:
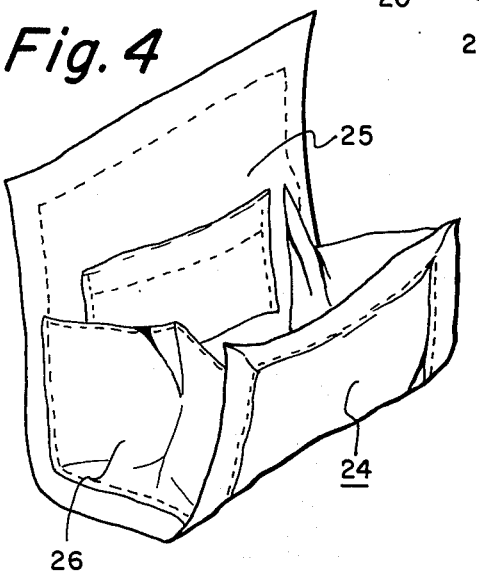
FIG. 4 is a perspective view of another embodiment of liner.

An alternate embodiment of liner 24 may be employed as shown in FIG. 4. The liner 24 inludes a basic panel 25 of length and width slightly less than the stiffening member as in the case of the panel 19 in the embodiment shown in FIG. 3. However, the liner 24 differs from that shown in FIG. 3 in that the flaps 26, which form the pocket of the liner, do not include the pressure sensitive material on the upper edge of the panel which permits the liner to be laid flat during the adhering process. Instead, the panels 26 are cut to form the pocket for the purse in the folded configuration and permanently sewn into place. When adhering the liner 24 to the stiffening member, the stiffening member has to be partially folded into the purse configuration to conform to the liner 24 as the iron is passed around the border of the liner.

The next step in the assembly of the purse of the present invention is the installation of the hardware which is provided with the kit. The hardware includes a lock assembly 27 which includes a locking nob 28 as shown in FIG. 5. This entire assembly includes bendable prongs 29 which are passed through predetermined perforations 30 in the prescored member shown in FIG. 2. The prongs 29 are bent over into locking engagement with a backup plate 31 positioned against the back side of the stiffening member.

The hardware further includes a locking eye 32 which is attached to the outside edge of the closure flap of the purse. In a like manner, the stiffening member includes predetermined apertures in the closure flap for positioning of the locking eye 32. The locking eye 32 includes bendable tabs 33 which secure the locking eye in place. In operation, the locking eye 32 is placed over the nob 28 and the nob rotated 90 degrees, as shown in FIG. 1, to secure the closure flap.

The hardware further includes four footrests 34. The bottom panel 14 of the stiffening member includes four apertures to position the footrests. The footrests include a round washer with a spike projecting from the washer which is passed through the aperture and engages an aperture in a round footpiece positioned on the opposite side of the stiffening member to interlock the two members in place.

The purse at this point is completely assembled. Where a liner of the embodiment shown in FIG. 3 has been used, all that now need be done is to fold the purse into the configuration shown in FIG. 1 by bending the panels along the score lines. The panels 21 of the liner are then used to form the pocket of the purse by engaging the strips of adhesive material 22 and 23 respectively along their edge as shown in FIG. 5. Where the liner as shown in FIG. 4 is used, this final step is unnecessary. The purse is then ready for use.

It will be appreciated that the foregoing purse kit of the present invention provides a means by which a purse can be quickly, inexpensively and easily assembled using a fabric from a presewn garment which will provide an identically matching purse.

The present invention has been described in respect to specific embodiments thereof shown in the drawing. Other modifications and embodiments will now become apparent to those skilled in the art by reason of the foregoing disclosure. Accordingly, no limitation as to the scope of the invention was intended by the showing of specific embodiments.

I claim:

1. A purse kit permitting the purchaser of the kit to assemble a hand purse having an outside covering material chosen and supplied by the purchaser including:

a substantially flat stiffening member prescored to permit subsequent folding into a purse configuration having at least front, back and closure panels and adapted to be covered on one side by the purchaser's choice of covering material;

a preformed liner having a first panel of peripheral configuration approximating the peripheral configuration of the stiffening member and adapted to be secured to the stiffening member on the opposite side thereof from the covering material and including two side panels each formed of an inwardly folded flap secured along one edge at opposite edges of the liner and each including securing means along the opposite edge thereof which permits the liner to be disposed flat while being secured to the stiffening member and to form a pocket by folding engagement of the opposite edge of each flap with itself as the stiffening member is folded into purse configuration.

* * * * *